US012365516B2

(12) United States Patent
Twiss et al.

(10) Patent No.: US 12,365,516 B2
(45) Date of Patent: Jul. 22, 2025

(54) METAL CONTAINER AND METAL CLOSURE THEREOF

(71) Applicant: Crown Packaging Technology, Inc., Alsip, IL (US)

(72) Inventors: Matthew Twiss, Wantage (GB); Benjamin Mattin, Wantage (GB)

(73) Assignee: Crown Packaging Technology, Inc., Alsip, IL (US)

( * ) Notice: Subject to any disclaimer, the term of this patent is extended or adjusted under 35 U.S.C. 154(b) by 127 days.

(21) Appl. No.: 17/774,948

(22) PCT Filed: Nov. 9, 2020

(86) PCT No.: PCT/EP2020/081519
§ 371 (c)(1),
(2) Date: May 6, 2022

(87) PCT Pub. No.: WO2021/089874
PCT Pub. Date: May 14, 2021

(65) Prior Publication Data

US 2022/0411140 A1 Dec. 29, 2022

(30) Foreign Application Priority Data

Nov. 8, 2019 (GB) ..... 1916302

(51) Int. Cl.
*B65D 43/02* (2006.01)
*B65D 6/28* (2006.01)
(Continued)

(52) U.S. Cl.
CPC ..... *B65D 43/0212* (2013.01); *B65D 7/04* (2013.01); *B65D 7/34* (2013.01); *B65D 51/18* (2013.01);
(Continued)

(58) Field of Classification Search
CPC ..... B65D 77/2032; B65D 51/18; B65D 7/04; B65D 41/045
See application file for complete search history.

(56) References Cited

U.S. PATENT DOCUMENTS 2,849,146 A * 8/1958 Wigert ..... B65D 41/045 220/296
4,202,462 A * 5/1980 Imber ..... B65D 43/0231 215/337
(Continued)

FOREIGN PATENT DOCUMENTS

EP 0003400 A1 8/1979
EP 2184237 A1 5/2010
(Continued)

*Primary Examiner* — Jeffrey R Allen
(74) *Attorney, Agent, or Firm* — Condo Roccia Koptiw LLP

(57) ABSTRACT

Container (1) comprising a substantially tubular metal container body (2) having a top opening defined by an outwardly curled edge, and a bottom opening. The container further comprises a peelable lid (9) bonded to an upper surface of said curled edge to close said top opening in an airtight manner, the outermost edge of the peelable lid not extending beyond an outermost extent of said curled edge, and a metal closure (4) comprising a generally planar centre panel (8) and a downwardly extending sidewall (7) depending from a peripheral region of the centre panel and terminating with an inwardly or outwardly directed fold (12), and a plurality of features (5) pressed into the sidewall at respective circumferentially spaced locations between said peripheral region and the fold, wherein the radial inward extent of the features is greater than that of the fold. The closure and the container body have relative dimensions to allow the features to pass over said curled edge during closure and to be retained beneath the curled edge to resist removal of the closure.

20 Claims, 7 Drawing Sheets

(51) Int. Cl.
*B65D 8/00* (2006.01)
*B65D 51/18* (2006.01)

(52) U.S. Cl.
CPC ..... *B65D 2251/0018* (2013.01); *B65D 2251/0093* (2013.01); *B65D 2543/00092* (2013.01); *B65D 2543/00277* (2013.01); *B65D 2543/00527* (2013.01); *B65D 2543/00537* (2013.01); *B65D 2543/00638* (2013.01); *B65D 2543/00685* (2013.01); *B65D 2543/00731* (2013.01); *B65D 2543/00805* (2013.01)

(56) References Cited

U.S. PATENT DOCUMENTS

| | | | | |
|---|---|---|---|---|
| 5,226,281 | A * | 7/1993 | Han | B65D 77/2056 53/412 |
| 6,059,134 | A * | 5/2000 | Long, Jr. | B65D 41/58 215/44 |
| 6,234,386 | B1 | 5/2001 | Drummond et al. | |
| 9,205,959 | B2 * | 12/2015 | Welk | B65D 43/0212 |
| 2007/0272693 | A1 | 11/2007 | Richards | |

FOREIGN PATENT DOCUMENTS

| | | | |
|---|---|---|---|
| FR | 2604976 | A1 | 4/1988 |
| GB | 458541 | A | 12/1936 |
| JP | 2001139013 | A | 5/2001 |

* cited by examiner

METAL CONTAINER AND METAL CLOSURE THEREOF

CROSS REFERENCE TO RELATED APPLICATIONS

This application is the National Stage Entry under 35 U.S.C. § 371 of Patent Cooperation Treaty Application No. PCT/EP2020/081519, filed 9 Nov. 2020, which claims priority from United Kingdom Application No. 1916302.1, filed 8 Nov. 2019, the contents of each of which are hereby incorporated by reference herein in their entireties.

TECHNICAL FIELD

The present invention relates to a metal container, and to a metal closure thereof. More particularly, the present invention relates to such containers and closures suitable for containing foodstuffs.

BACKGROUND

Tube style containers for containing foodstuffs such as crisps (or "chips") are well known and generally comprise a cylindrical composited tube (e.g. layers of paper, cardboard, polymer, aluminium foil, cardboard) formed by spiral winding and bonding. The bottom of the tube is closed with a circular metal end using an end seaming process. The top of the tube may be folded over so as to provide an upper rim that surrounds the opening. In order to close the top opening of the tube, a composite peelable lid is secured to the upper rim surrounding the opening, e.g. using a heat sealing process. The lid may be formed of a thin layer of metalized plastic.

In order to protect the peelable lid during filling, transit and storage, a plastic overcap is usually provided, the overcap snap-fitting over the end above the peelable lid. As well as providing this protection, the plastic overcap allows reclosure of the container after a consumer has opened the container by either fully or partially removing the peelable lid.

It is extremely desirable to reduce the use of plastics in disposable products and to replace these with more fully recycle-able materials such as metals.

SUMMARY

According to the present invention there is provided a container comprising a substantially tubular metal container body having a top opening defined by an outwardly curled edge, and a bottom opening. The container further comprises a peelable lid bonded to an upper surface of said curled edge to close said top opening in an airtight manner, the outermost edge of the peelable lid not extending beyond an outermost extent of said curled edge, and a metal closure comprising a generally planar centre panel and a downwardly extending sidewall depending from a peripheral region of the centre panel and terminating with an inwardly or outwardly directed fold, and a plurality of features pressed into the sidewall at respective circumferentially spaced locations between said peripheral region and the fold, wherein the radial inward extent of the features is greater than that of the fold. The closure and the container body have relative dimensions to allow the features to pass over said curled edge during closure and to be retained beneath the curled edge to resist removal of the closure.

The features may be pips or beads.

The metal closure may comprise three features substantially equi-angularly spaced around the circumference of said sidewall.

The peelable lid may comprise a layer of aluminium foil bonded to a layer of polypropylene, the bond between the peelable lid and said upper surface of said curled edge being formed between the polypropylene and the metal of the curled edge.

The tubular metal container may be a circular cylinder and said metal closure may be substantially circular.

The container may comprise a metal end, seamed to said bottom opening to close the bottom opening in a substantially airtight manner.

A gap between said outermost edge of the peelable lid and an outermost extent of said curled edge may be in the region of 0.1 to 0.2 mm, for example 0.16 mm. Each said feature may have an innermost surface with an axial extent of between 1 and 3 mm.

The peelable lid and said features may either not overlap to a radial extent or may overlap by 0.2 mm or less.

The downwardly extending sidewall of the metal closure may have a length in the range 6 to 10 mm, preferably 8 mm.

The curled edge of the container body may be open.

The inwardly directed fold may have a radial extent of between 0.65 and 0.85 mm, for example 0.75 mm.

Each of said features have inclined upper and lower surface regions. This facilitates pressing of the closure over the outwardly curled edge of the top opening of the container body.

An innermost radius of said inwardly directed fold of the closure may be less than an outermost radius of the outwardly curled edge of the container body, but said innermost radius lying outside of the innermost extent of said features. This arrangement allows for the inwardly directed fold to very easily snap over and under the outwardly directed fold of the top opening of the container body.

DETAILED DESCRIPTION

A tubular container will now be described that is substantially made of metal to allow for recycling. The container is suitable for containing a foodstuff such as crisps, providing a substantially air and water-tight seal prior to first opening. The closure is also designed to be re-closable such that when reclosed the interior of the container is protected from dust and other contaminants.

Figure 1:
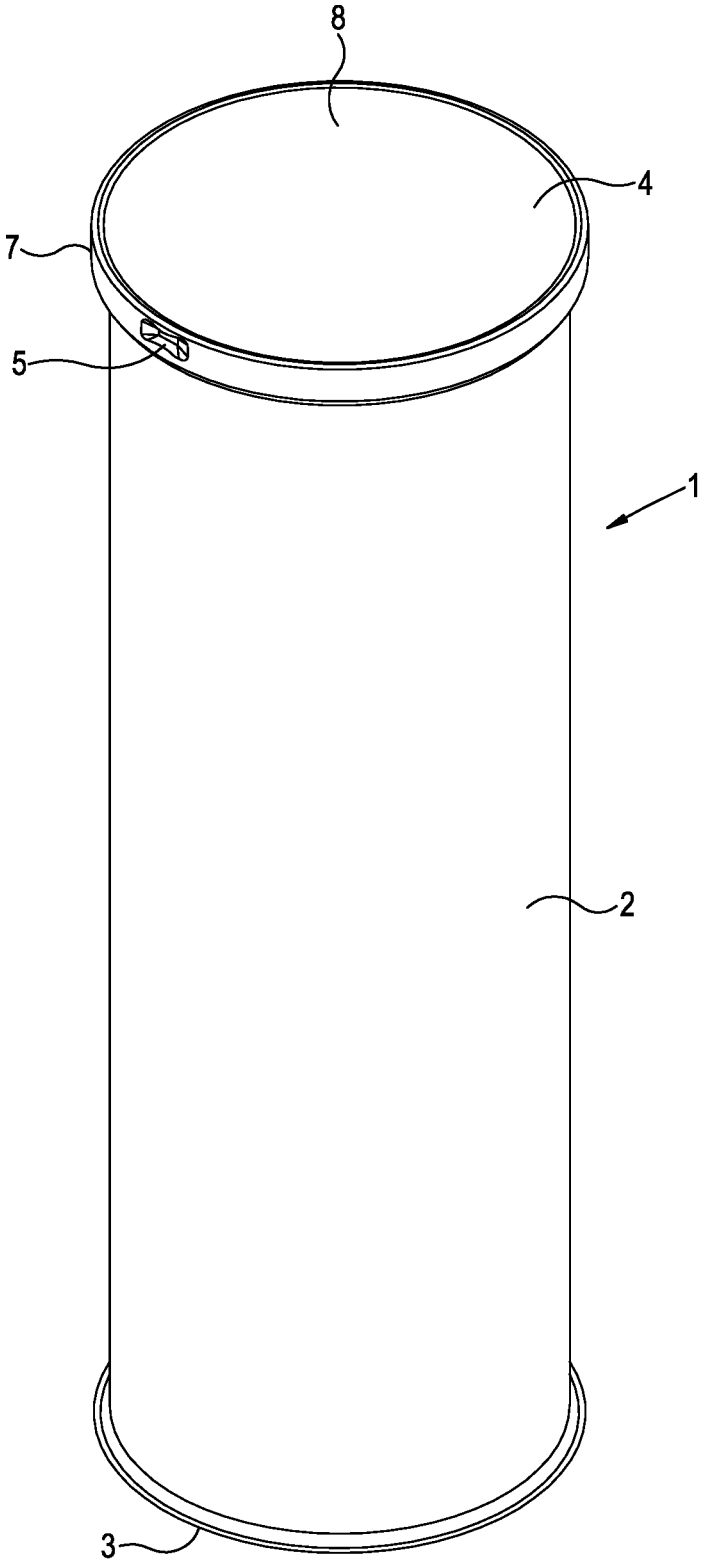
FIG. 1 illustrates schematically a tubular container for containing a foodstuff.

FIG. 1 is an isometric view of the container 1 prior to first opening. The container comprises a tubular metal body 2 formed by rolling a rectangular flat sheet into a cylinder and joining the abutting ends by welding, such that a seam (not shown in the drawing) is formed along the length of the container body. A generally circular end 3 is secured to the base of the container body using a conventional seaming process, e.g. involving curling an upstanding wall of the end together with the bottom rim of the container body to form a curl within a curl. A metal overcap or closure 4 is fixed to the top of the tubular body using a snap-fit mechanism involving a number or inwardly projecting and circumferentially spaced features 5 which, in this case, are formed as "pips" (only one of the pips is visible in the drawing). The closure diameter is 79 mm. In this example the closure comprises three pips 5, spaced at 120 degree intervals around wall 7 of the closure, surrounding a closure centre panel 8. As described below, a peelable foil lid (not visible in FIG. 1) is sealed to the end of the tubular body and sits beneath the closure 4. The tubular metal body may be "necked" at one or both of the top and the bottom, such that the body tapers inwardly towards the end(s). This may be desirable for performance and/or cost reasons.

The tubular body 2, end 3 and closure 4 may be made of any suitable and recycle-able metal, such as tin-plated steel.

Although not described here in detail, a container manufacturer might provide the container body to a product filler with the peelable foil lid and closure in place, but with the bottom end open. The filler fills the container with product through the open bottom end before closing the container by seaming on the end 3.

Figure 3:
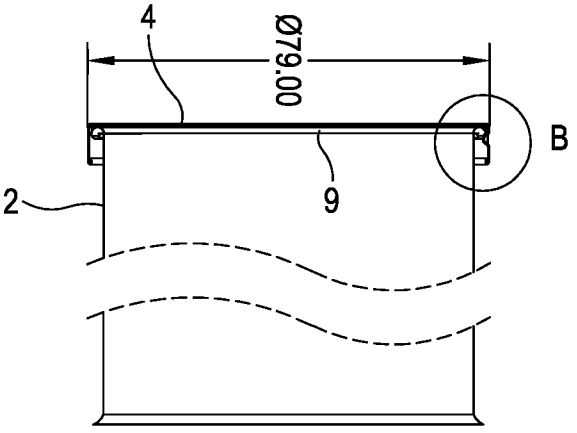
FIG. 3 shows a vertical cross-section through the container of FIG. 1.
Figure 2:
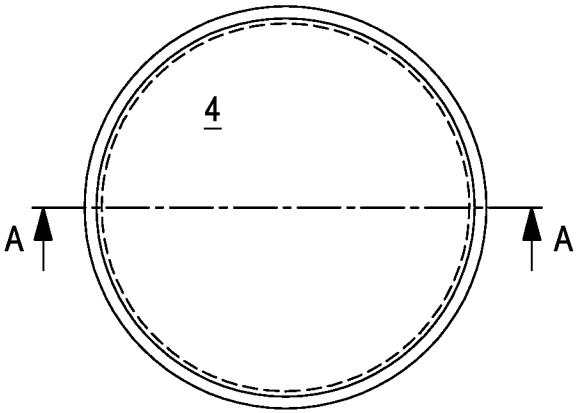
FIG. 2 shows a top plan view of the container of FIG. 1.

FIG. 2 is a top plan view of the container 1 of FIG. 1 and in which only the metal closure 4 is visible, whilst FIG. 3 shows a vertical cross-section taken along the line A-A of FIG. 2. Visible in this drawing are the tubular metal body 2 and the metal closure 4, as well as a peelable foil lid 9 which sits beneath the closure. The foil lid 9 may be formed of a multi-layer material, for example a top layer of aluminium foil (e.g. 60 microns or less in thickness) and a lower layer of polypropylene, PPE (e.g. 40 microns in thickness or less). The foil lid may be formed with corrugations, ridges, or other regular or non-regular deformations for the purpose of taking up slack in the material and/or providing improved pressure performance of the closed container. It is noted that the peelable lid may be made of other suitable materials including paper, cardboard and plastics, or any combination of these.

Figure 4:
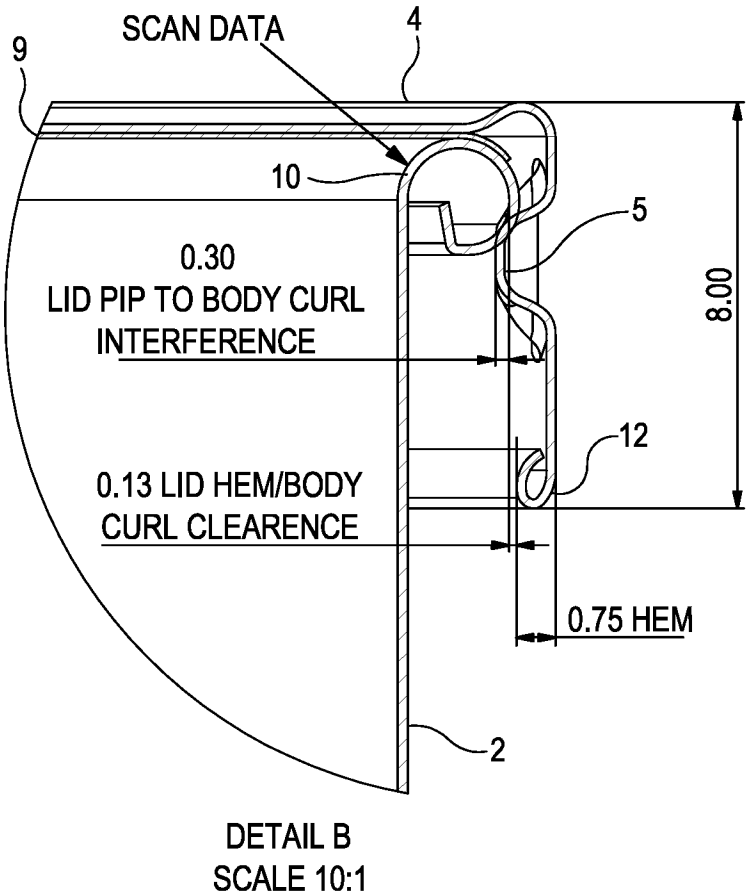
FIG. 4 shows an enlarged detail B of the cross-sectional view of FIG. 3.
Figure 5:
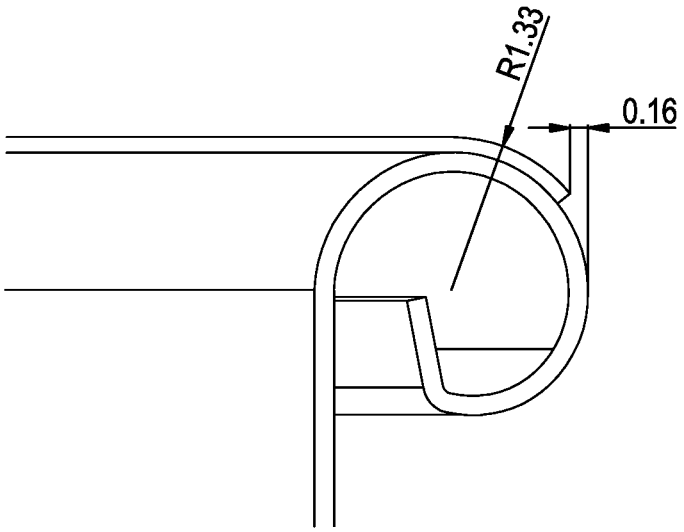
FIG. 5 further illustrates a detail of the cross-section of FIG. 3 showing a region of the container body with peelable lid.
Figure 6:
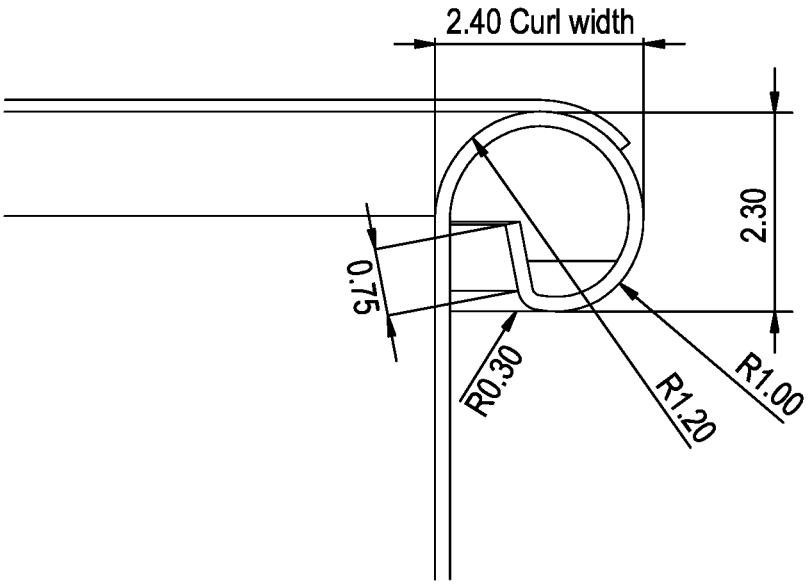
FIG. 6 further illustrates the detail of FIG. 5.

FIG. 4 shows a detail B of the vertical cross-section of FIG. 3, illustrating certain dimensions of the container and further illustrating the position of the peelable foil lid 9. It will be appreciated that the upper end of the tubular boy is provided with an outwardly directed curl 10 such that the outer diameter of the curl is 77.6 mm (the outwardly directed curl lies radially outside of the tubular body). Further dimensional details of the curl are shown in FIGS. 5 and 6. A peripheral and circumferential region (outer edge) of the foil lid 9 is bonded to an upper surface of the curl 10. This may be achieved using a heat seal process, which uses induction heating to heat the tubular body 2 in the region of the curl 10. The foil lid 9 is then applied over the opening with a pressure applied to press the peripheral region onto the curl 10. The residual heat softens the PP layer without causing any significant flow of material. As the PP cools, a bond is formed between it and the surface of the curl 10. The outermost edge of the foil lid 9 stops short of the outermost surface of the curl 10. The gap between these two regions is 0.16 mm.

Figure 7:
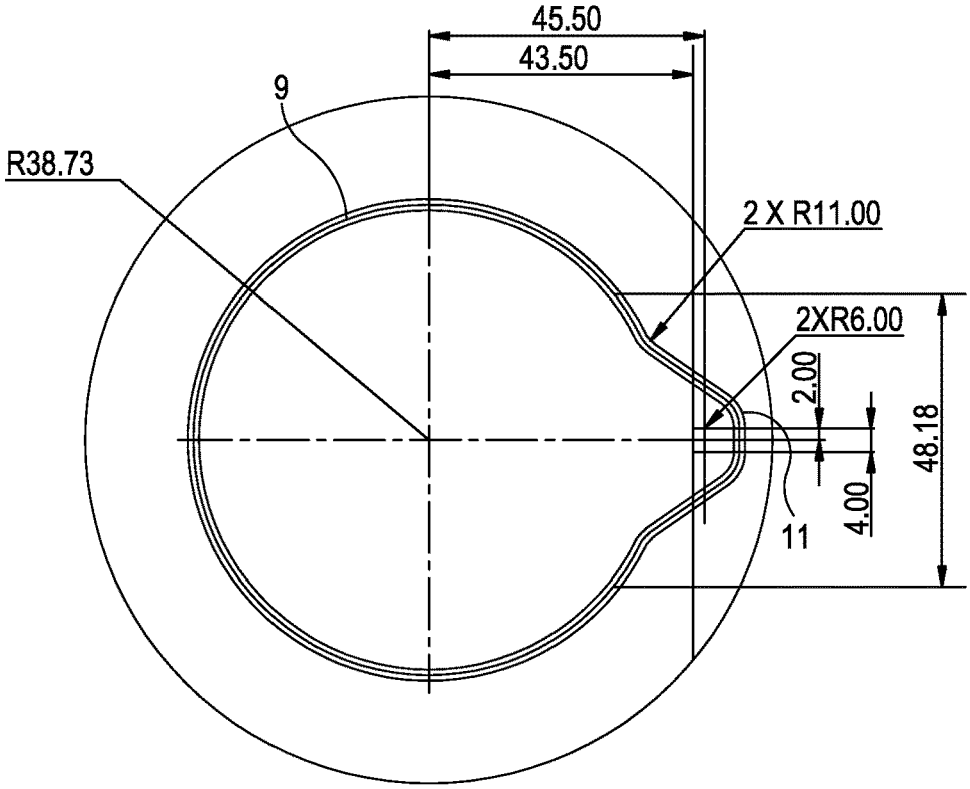
FIG. 7 is a plan view of the peelable lid.

FIG. 7 shows a plan view of the foil lid 9, which includes a (pull) tab 11 to aid removal of the foil lid flowing removal of the closure 4 by a consumer. The tab may fully extend over the curl 10, being pressed over the outside of the tubular body by the closure 4, or may be folded back over the main body of the lid so that it is hidden by the closure (prior to first opening).

Figure 8:
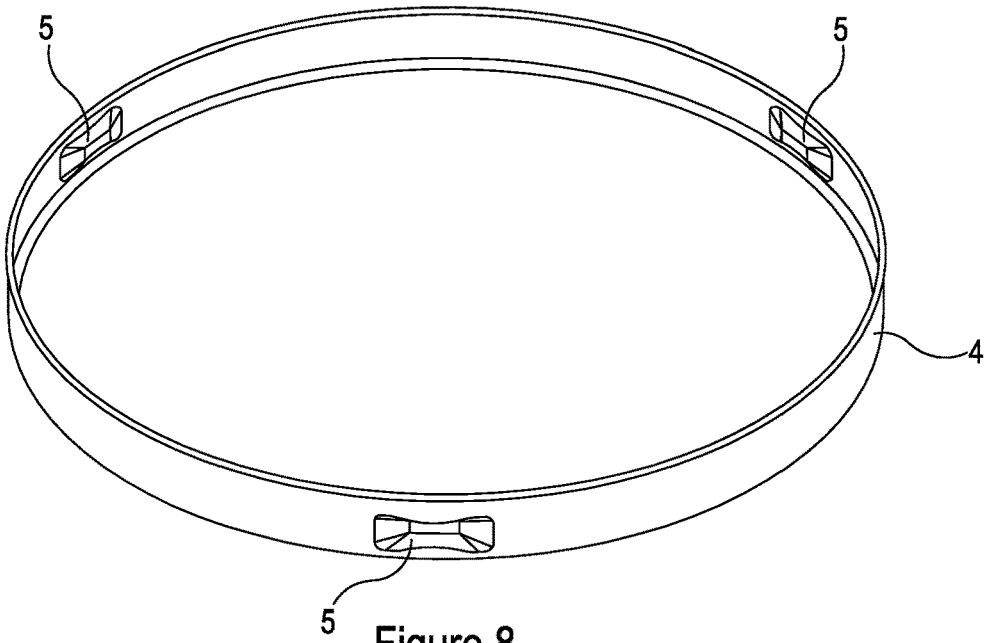
FIG. 8 is a top perspective view of the upturned metal closure.
Figure 9:
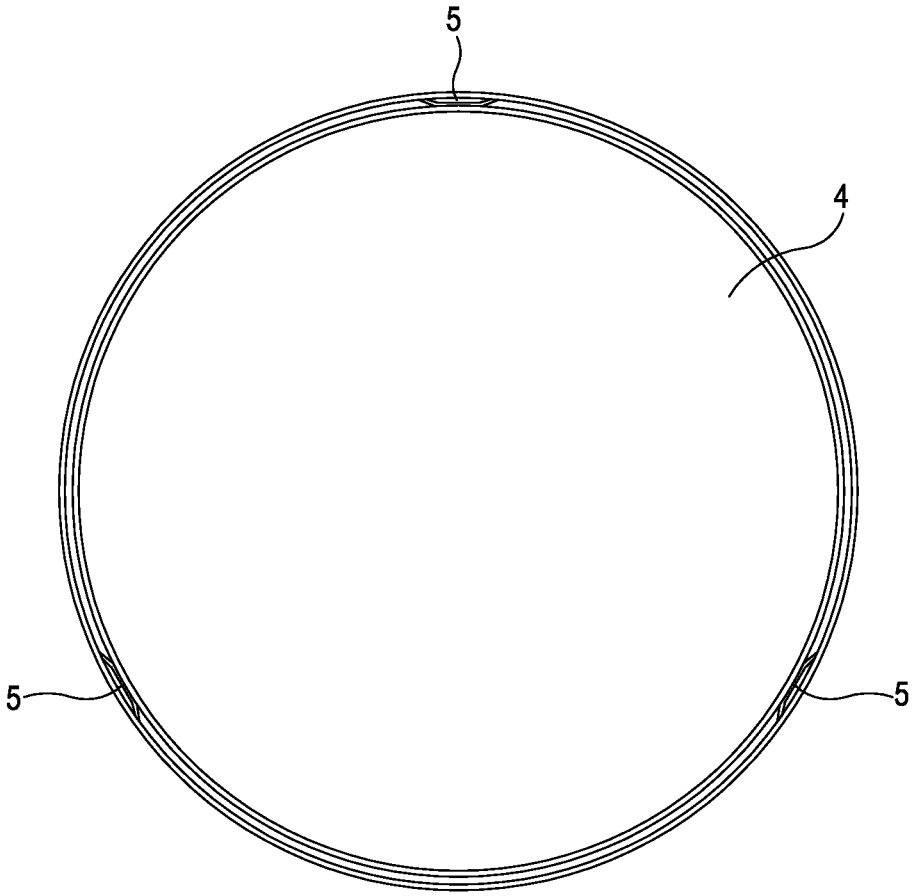
FIG. 9 is a plan view of the upturned metal closure.

FIG. 8 shows an isometric view of the closure 4 removed from the container body 2 and upturned. In this view, the three circumferentially spaced pips 5 are clearly visible. Each pip may have an angular extent of less than 10 degrees, optionally less than 5 degrees, with sloping sidewalls extending from the outermost edge of the pip to an innermost rectangular region. As is apparent from FIG. 4, the lowermost edge of the closure wall 7 is provided with a narrow inwardly directed fold such as a hem or curl 12 having a radial extent of 0.75 mm. [As will be apparent from the drawings, the fold 12 of this embodiment does not extend radially beyond the closure wall 7 so that the circumference of the closure presents an essentially flush surface.] The fold 12 may be flattened to some extent or otherwise formed flat, to provide a "hem". The pips on the other hand have a greater radial extent of 1.18 mm (0.75+0.3+0.13). The extent of the overlap between the innermost surface of the closure fold 12 and the outermost surface of the body curl 10 is in the region of 0.13 mm, whilst that between the innermost surface of the pip 5 and the outermost surface of the body curl 10 is in the region of 0.3 mm. These dimensions allow the closure 4 to be easily pressed onto the end of the closure whereupon the pips 5 snap in beneath the body curl 10 to retain the closure in place.

Equally, only a relatively small force is required to remove the closure. NB. The sloping faces of the pips 5 help to reduce the forces required to press on and remove the closure.

It will be appreciated that there is no overlap in a radial sense between the closure fold 12 and the peelable lid 9, whilst there is only a very small overlap, in the region of 0.3 mm, between the pip 5 and the lid 9. This, in conjunction with the height of the innermost surface of the pips, means that neither the closure fold 12 nor the pip, or indeed any other part of the closure sidewall makes contact with the foil lid during closure and opening. There is therefore minimal risk of the lid being disturbed or damaged during these operations.

Figure 10:
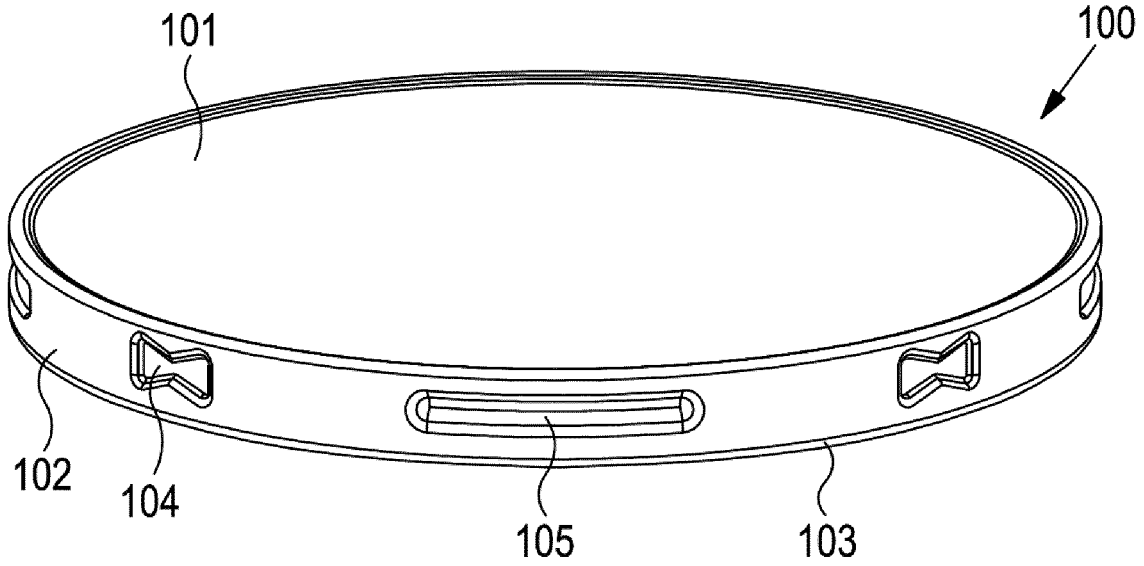
FIG. 10 is a top perspective view of a closure for an alternative container construction.
Figure 11:
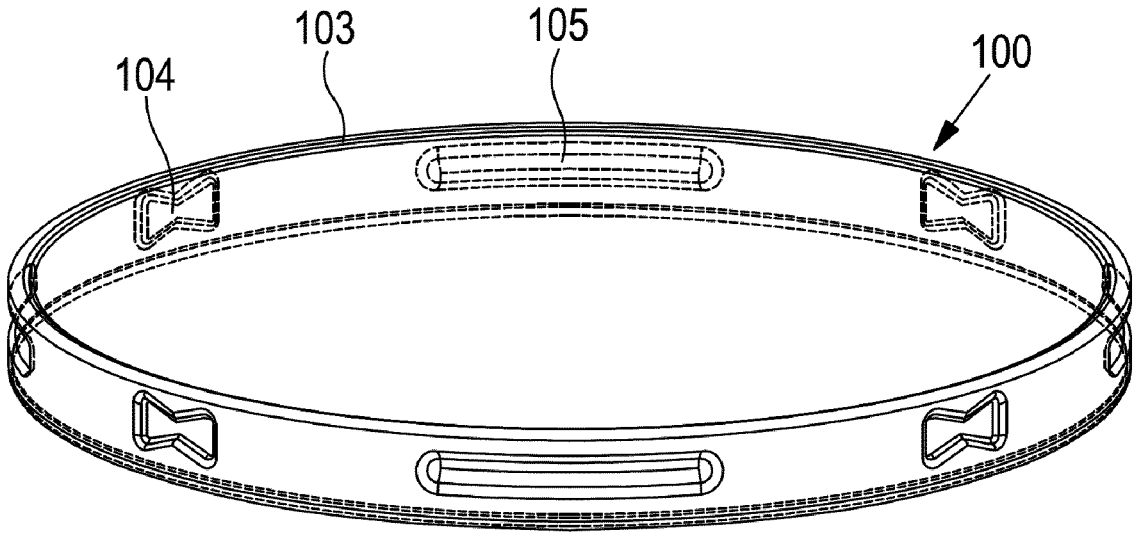
FIG. 11 is a bottom perspective view of the closure of FIG. 10.

FIGS. 10 to 13 illustrate an alternative container construction and specifically an alternative closure construction. FIGS. 10 and 11 show the closure 100 comprising a central, circular, panel region 101, and a cylindrical sidewall 102 depending from the central panel. The sidewall terminates in an inwardly directed fold that is provided as a hem (or curl) 103. Four equally spaced pips 104 are pressed into the sidewall, as are four equally spaced features 105, with the pips and features alternating around the sidewall circumference. In this case the features are beads that may have an angular extent of between 10 and 60 degrees.

Figure 12:
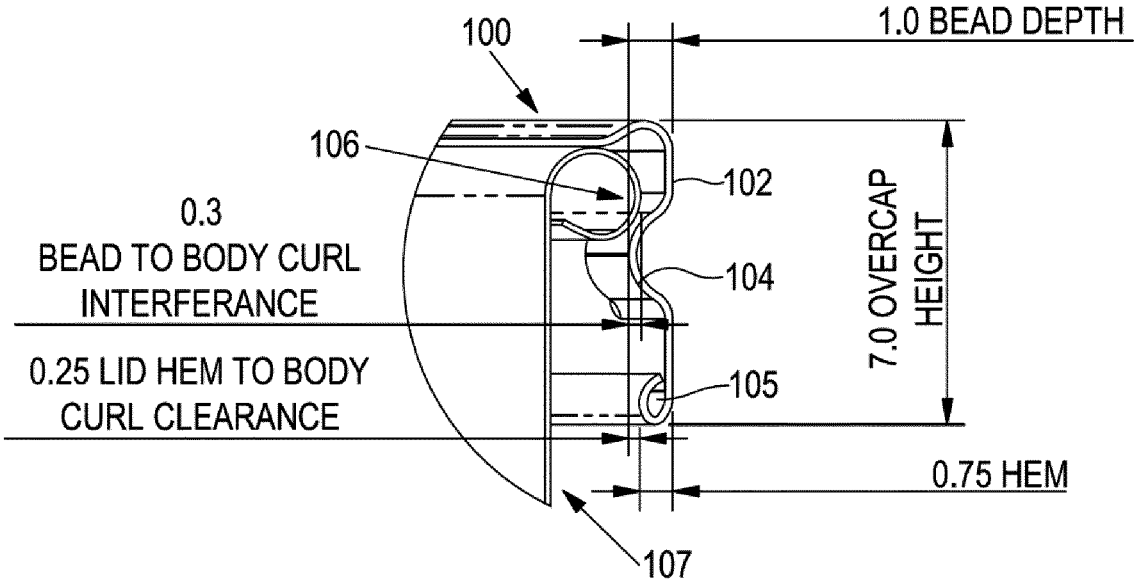
FIG. 12 is a vertical cross-section through an alternative container design at a first radial position.
Figure 13:
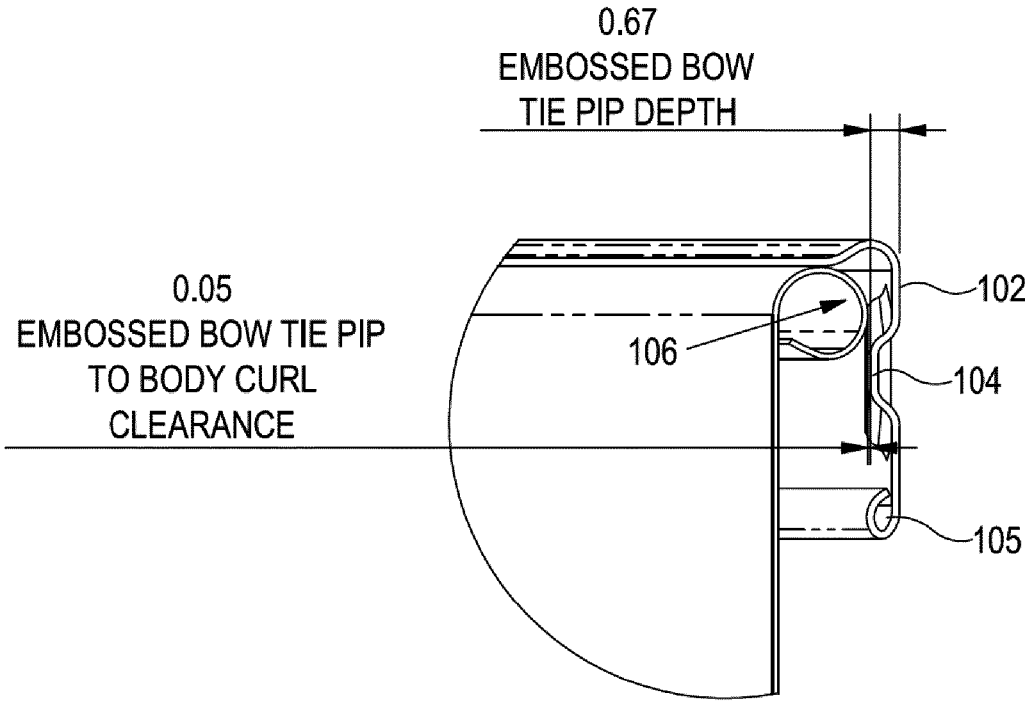
FIG. 13 is a vertical cross-section through an alternative container design at a second radial position.

In this construction, the beads extend inwardly to a greater radial extent than do the pips, such that it is the pips that interfere with the curl 106 at the top of the container body 107, and not the pips. This is illustrated by the vertical cross-sections of FIGS. 12 and 13, where FIG. 12 shows a cross-section through one of the beads, whilst FIG. 13 shows a cross-section through one of the pips. As indicated, the radial overlap between the curl 106 of the container body and the beads 105 is 0.3 mm, whilst the radial spacing (gap) between the curl 106 and the pips 104 is 0.05 mm. The total embossed depth of the beads is 1 mm whilst that of the pips is 0.67 mm. The pips 104 of this design provide decorative features as well as reinforcement of the sidewall 102.

It will be appreciated by the person of skill in the art that various modifications may be made to the above described embodiments without departing from the scope of the present invention. For example, whilst said fold of the closure has been described as being an inwardly directed fold, it may alternatively be an outwardly directed fold, e.g. being an outwardly directed curl or hem of similar dimensions.

The invention claimed is:

1. A container comprising:

a substantially tubular metal container body having a top opening that is (i) defined by and (ii) consists of an outward curl that is uniform about the top opening, and having a bottom opening;

a peelable lid bonded to an upper surface of said curl to close said top opening in an airtight manner, an outermost edge of the peelable lid not extending beyond an outermost extent of said curl; and a metal closure comprising a generally planar centre panel and a downwardly extending sidewall depending from a peripheral region of the centre panel and terminating with an inwardly or outwardly directed fold, and a plurality of features pressed into the sidewall at respective circumferentially spaced locations between said peripheral region and the fold, wherein the radial inward extent of the features is greater than that of the fold, the closure and the container body having relative dimensions to allow the features to pass over said curl during closure and to be retained beneath the curl to resist removal of the closure.

2. A container according to claim 1, wherein said features comprise three or more features substantially equi-angularly spaced around the circumference of said sidewall.

3. A container according claim 1, wherein said peelable lid comprises a layer of aluminium foil bonded to a layer of polypropylene, the bond between the peelable lid and said upper surface of said curl being formed between the polypropylene and the metal of the curl.

4. A container according to claim 1, wherein said tubular metal container is a circular cylinder and said metal closure is substantially circular.

5. A container according to claim 1 further comprising a metal end, said metal end seamed to said bottom opening to close the bottom opening in a substantially airtight manner.

6. A container according to claim 1, wherein a gap between said outermost edge of the peelable lid and the outermost extent of said curl is in the region of 0.1 to 0.2 mm.

7. A container according to claim 1, wherein each of said features has an innermost surface with an axial extent of between 1 and 3 mm.

8. A container according to claim 7, wherein said peelable lid and said features to a radial extent or overlap by 0.2 mm or less.

9. A container according to claim 1, wherein said downwardly extending sidewall of the metal closure has a length in the range of 6 to 10 mm.

10. A container according to claim 1, wherein said curl of the container body is open.

11. A container according to claim 1, wherein said fold having a radial extent of between 0.65 and 0.85 mm.

12. A container according to claim 1, wherein each of said features has inclined upper and lower surface regions.

13. A container according to claim 1, wherein said fold is an inwardly directed fold and an innermost radius of the fold is less than an outermost radius of the curl of the container body said innermost radius of the fold lying outside of the innermost extent of said features.

14. A container according to claim 1, wherein the tubular metal container body being necked at one or both of its top and bottom ends.

15. A container according to claim 1, wherein said features are pips.

16. A container according to claim 1, wherein said features are beads.

17. A container according to claim 16, wherein said metal closure additionally comprising a plurality of pips pressed into the closure sidewall between said beads, said pips extending radially inwardly from the closure sidewall to an extent which does not interfere with the outwardly curl of the tubular body.

18. A container according to claim 1, wherein said fold of the metal closure is formed as a curl or hem.

19. A container according to claim 9, wherein said downwardly extending sidewall of the metal closure has a length in the range 7 to 8 mm.

20. A container comprising:

a substantially tubular metal container body having a top opening defined by a curl that is uniform about the top opening, and having a bottom opening;

a peelable lid bonded to an upper surface of said curl to close said top opening in an airtight manner, the curl defining a circular shape in cross section where the peelable lid is bonded to the curl, an outermost edge of the peelable lid not extending beyond an outermost extent of said curl; and a metal closure comprising a generally planar centre panel and a downwardly extending sidewall depending from a peripheral region of the centre panel and terminating with an inwardly or outwardly directed fold, and a plurality of features pressed into the sidewall at respective circumferentially spaced locations between said peripheral region and the fold, wherein the radial inward extent of the features is greater than that of the fold, the closure and the container body having relative dimensions to allow the features to pass over said curl during closure and to be retained beneath the curl to resist removal of the closure such that the features engage the curl in a snap fit.

* * * * *